United States Patent [19]

Civolani et al.

[11] 4,035,943

[45] July 19, 1977

[54] RADIAL PERCUSSION ARRANGEMENT FOR FIREARMS USING SELF-PROPELLING AMMUNITION WITH PERIPHERIAL PRIMING

[76] Inventors: Bruno Civolani, Via Franco Bolognese, 2 Bologna; Paolo Benelli, Via Cesare Battisti, 9 Pesaro, both of Italy

[21] Appl. No.: 670,989

[22] Filed: Mar. 26, 1976

[30] Foreign Application Priority Data

Apr. 14, 1975 Italy ..... 44008/75

[51] Int. Cl.[2] ..... F41C 19/00; F41C 11/00

[52] U.S. Cl. ..... 42/69 B; 42/16; 42/69 R

[58] Field of Search ..... 42/69 B, 69 R, 69 A, 42/16

[56] References Cited

U.S. PATENT DOCUMENTS

| | | | |
|---|---|---|---|
| 2,099,993 | 11/1937 | Tauschek | 42/69 R |
| 3,087,428 | 4/1963 | French, Jr. | 42/69 R |
| 3,571,961 | 3/1971 | Lehtinen | 42/69 R |

*Primary Examiner*—Charles T. Jordan
*Attorney, Agent, or Firm*—Amster & Rothstein

[57] ABSTRACT

A radial percussion arrangement for firearms using self-propelling ammunition with peripherial priming is provided. The arrangement comprises a firing pin inserted in an inclined bore provided in the upper portion of the breech. The inclination of this bore and consequently of the firing pin is such that the tip of the firing pin is turned towards the breech face. In the case of firearms having a bolt of striking weight type a locking rod is provided in the bolt. This locking rod has the function to pick up a projectile from the magazine and insert it in the chamber. Since the locking rod enters the chamber, it acts also as a locking element for the chamber.

6 Claims, 4 Drawing Figures

RADIAL PERCUSSION ARRANGEMENT FOR FIREARMS USING SELF-PROPELLING AMMUNITION WITH PERIPHERIAL PRIMING

The present invention relates generally to weapons capable of firing by radial percussion new devised ammunition (e.g. of the type described in Italian Pat. Nos. 932,381 and 972,058) provided with peripherial priming.

The heretofore known percussion arrangements are exclusively used to strike conventional ammunition of the center or annular percussion type.

The present invention is directed to a percussion arrangement for firearms using self-propelling ammunition with peripherial priming. All attempts in striking the above-mentioned ammunition by using conventional arrangements (e.g. firing pin recoiled by springs or levers) have given negative results because deformations and scores in the outer wall of the projectile occur.

At the time of firing, when the firing pin strikes against the outer wall of the projectile at the primer, the reaction force of the projectile is so violent and quick that no recoil means of the firing pin is capable of advancing the ejection of the projectile from the barrel. As a result, the firing pin notches the projectile causing deformations thereon which cause aerodynamic changes in the trajectory of the projectile resulting in lack of firing precision.

The object of the present invention is to obviate this disadvantage.

More particularly, the radial percussion arrangement for firearms according to the invention is characterized in that the firing pin is arranged in an inclined bore provided in the upper portion of the breech and communicating with the chamber, the firing pin axis being inclined so as the tip thereof is turned towards the breech face.

Assuming by way of example that the arrangement according to the invention is embodied in a weapon having a bolt of striking weight type, the main components thereof are:

A — firing pin arranged at the upper portion of the breech,

B — hammer pivotally mounted on the receiver above the breech,

C — L-shaped flat spring for the hammer percussion, restrained at one end on the upper portion of the bolt, D — bolt of striking weight type having a locking rod extending from the surface abutting the breech face.

A. On the upper portion of the breech a firing pin receiving bore is provided, which opens in the chamber in a location on the projectile where the peripherial primer of the charge is located. This bore is inclined in such a way that, with the firing pin mounted therein, the pin tip is turned towards the breech face. Since the firing pin is not provided with a recoil spring, the firing pin tends always, by its own weight, to keep the tip thereof either projecting in the firearm chamber when it is empty, or contacting the projectile when the latter is located in the barrel. The firing pin tends therefore to counteract the reaction force of the projectile which, violently ejected from the barrel, lifts the firing pin without being deformed or notched thereby. The action exerted by the fired projectile on the firing pin is also aided by the action of gas developed by the charge explosion which pushes upwardly the firing pin through a passage radially provided in the chamber and communicating the rear portion thereof with the firing pin bore. Upon firing of the weapon, the gas pressure acts not only on the projectile, but, through the radial passage, also on the firing pin tip pushing it upwardly. This is possible also due to the action exerted on the firing pin by the hammer which is described hereinafter.

B. The arrangement according to the present invention uses a very light hammer, pivotally mounted above the breech and having the form of a two-armed lever. The hammer is at all time held out of engagement with the firing pin by the action of a leaf spring secured at one end to the receiver and acting with the other end on the rear portion of the hammer.

C. Since the hammer is very light, the kinetic energy it acquires as a result of the velocity imparted by a L-shaped flat spring is used for the percussion of the hammer, this L-shaped spring being fastened to the breech and striking against the rear portion of the hammer during the locking step of the weapon. In this manner the hammer pivots in a counterclockwise direction with such a velocity as to develop a sufficient kinetic energy upon striking the firing pin to assure the percussion of the projectile once it is already located in the barrel. At the same time, because the hammer is very light and the leaf spring urges the hammer away from the firing pin, the movement of the hammer is reversed so quickly that the projectile during its forward projection encounters a so little resistance by the firing pin as to lift the latter without being deformed or scored at the contact point with the firing pin.

D. The bolt carrying on its upper portion the L-shaped flat spring is of a striking weight type. However, it differs from the conventional bolts of this type in that a locking rod is provided therein, which projects from the front locking surface of the bolt towards the breech face, has the function to introduce a projectile into the barrel after having picked it up from a magazine and enters the chamber by a predetermined length so as to form a closure therefore. By means of this system, as the inertial mass of the bolt begins to recoil as a result of the pressure of gas developed by the charge explosion, the locking of the weapon is still maintained until the locking rod is fully ejected from the chamber. In this manner there is provided for the lack of cartridge case in this new type of projectile without excessively increasing the bolt weight with respect to the conventional bolts of the striking weight type.

This invention will be described in more detail in the following description given by way of example only and therefore not intended in limiting sense, taken in connection with an embodiment applied to a firearm having a bolt of the striking weight type, with all parts operating in a manner similar to the presently used firearms being omitted.

In the accompanying drawings different operating steps of the arrangement according to the invention are shown.

Figure 4:
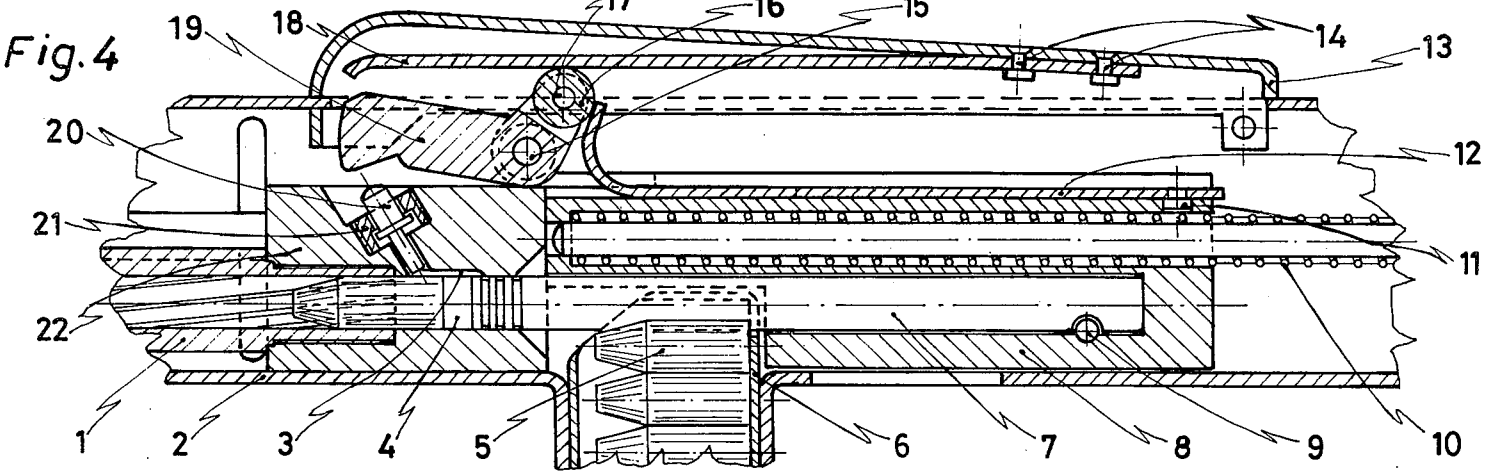

FIG. 4 is a sectional view of the radial percussion arrangement just after the percussion step, i.e. when the projectile begins to move forwardly by lifting the firing pin while the hammer has been already brought out of engagement with the firing pin by the force exerted by the leaf spring bearing on the rear end of the hammer. In this step the bolt of striking weight type is still in locking position because it has not yet begun the rearwardly movement due to the inertia of its mass and the recoil spring.

Figure 1:
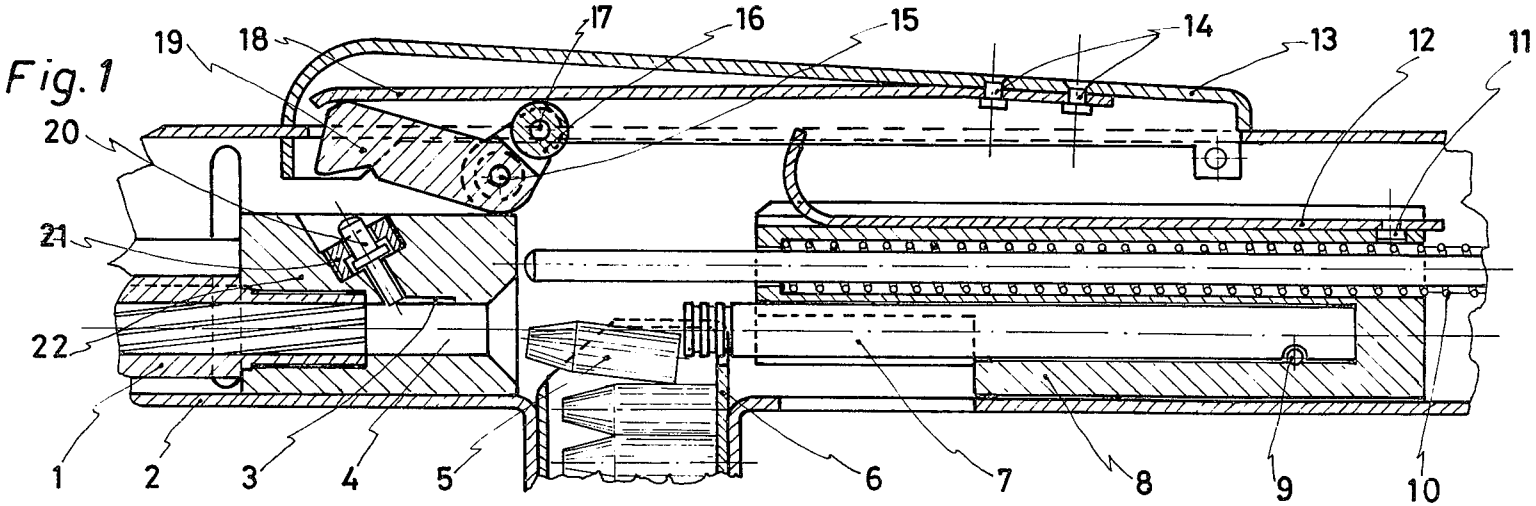
FIG. 1 is a sectional view of the radial percussion arrangement with the bolt being brought in a locking position by the recoil spring and with the bolt locking rod beginning to introduce a projectile into the barrel.

FIG. 1 shows the bolt in the locking stroke in which the projectile 5 is picked up from the magazine 6 and is introduced in the chamber 4 by the locking rod 7 fastened to the bolt 8 by means of a pin 9, this movement being caused by the recoil spring 10.

During this locking stroke the hammer 19 pivotally mounted on the receiver 2 through the pivot 15 is held out of engagement with the firing pin 20 by means of a leaf spring 18 which is fastened to the cover 13 through rivets 14 and contacts the near end 16 of the hammer 19 comprising a roller rotating about a pivot 17 in order to limit the friction between the hammer contacting members and the hammer.

Furthermore it is seen that the firing pin 20 is mounted on the upper portion of the breech 22 in an inclined position within a bore, with the tip turned towards the breech face and that, when there is not a projectile 5 in the chamber 4, the firing pin 20, retained by a ring nut 21, projects with one of its ends in the chamber 4 provided in the breech 22.

Further, a passage 3 is radially provided in the chamber 4 and a flat spring 12 is fastened to the bolt 8 by means of a pin 11, this flat spring 12 having the front end bent in the form of a L and intended to strike the rear end 16 of the hammer 19.

Figure 2:
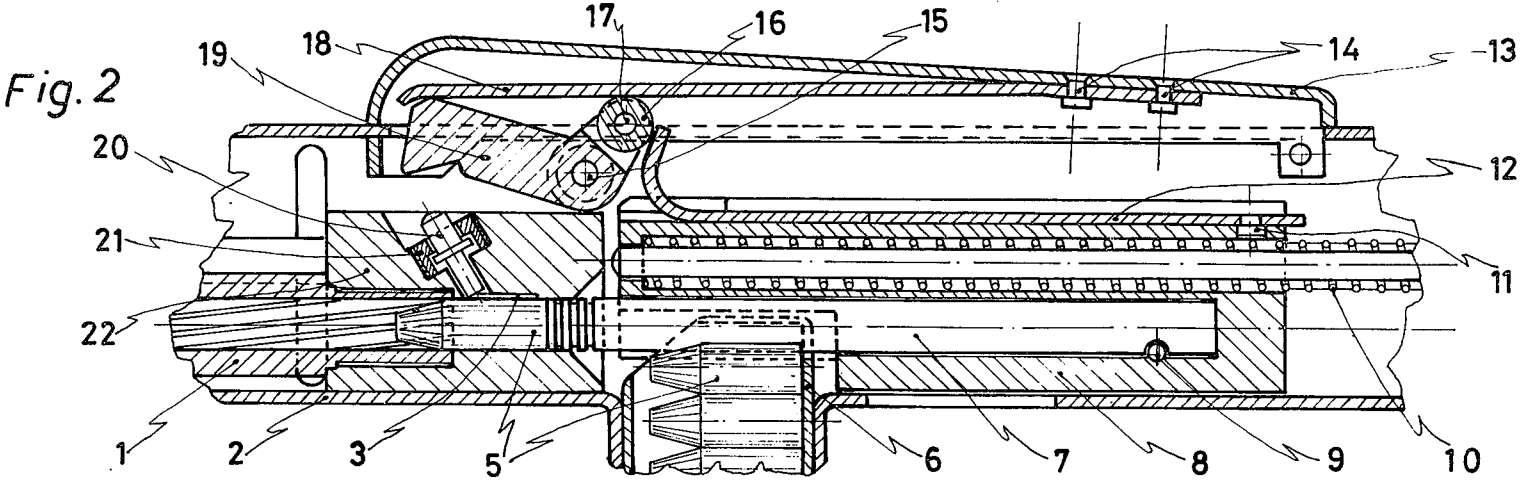
FIG. 2 is a sectional view of the radial percussion arrangement with the bolt having already introduced the projectile into the barrel and with the L-shaped flat spring fastened to the upper portion of the bolt just striking against the hammer.

In FIG. 2 it is seen that, once the projectile 5 has been introduced into the chamber 4 by the locking rod 7, the firing pin 20 has been retracted by the projectile within a seat provided in the locking ring nut 21 but it is always in contact with the projectile 5. Furthermore, before the bolt 8 abuts the locking surface of the breech 22, the L-shaped front end of the flat spring 12 contacts the roller 16 of the hammer 19 which is still held out of engagement with the firing pin 20 by the leaf spring 18. Since the contact between the roller 16 and the L-shaped end of the spring 20 is a yieldable contact a minimum of the velocity imparted to the bolt by the recoil spring 10 is lost.

As the bolt 8 is finishing its locking stroke, there is a brief delay in the rotation of the hammer in a counterclockwise direction because of the action of the leaf spring 18 and the shape of the hammer. This brief delay together with the force developed by the velocity and mass of the bolt 8 cause the L-shaped end of the flat spring 12 to be put under tension and simultaneously with the impact of the bolt 8 against the locking surface of the breech 22 the spring 12 releases the force stored on the rear end roller 16 of the hammer 19 just at the time that the hammer begins to rotate in a counterclockwise direction about the pivot 15 after having overcome the resistance of the leaf spring 18.

Figure 3:
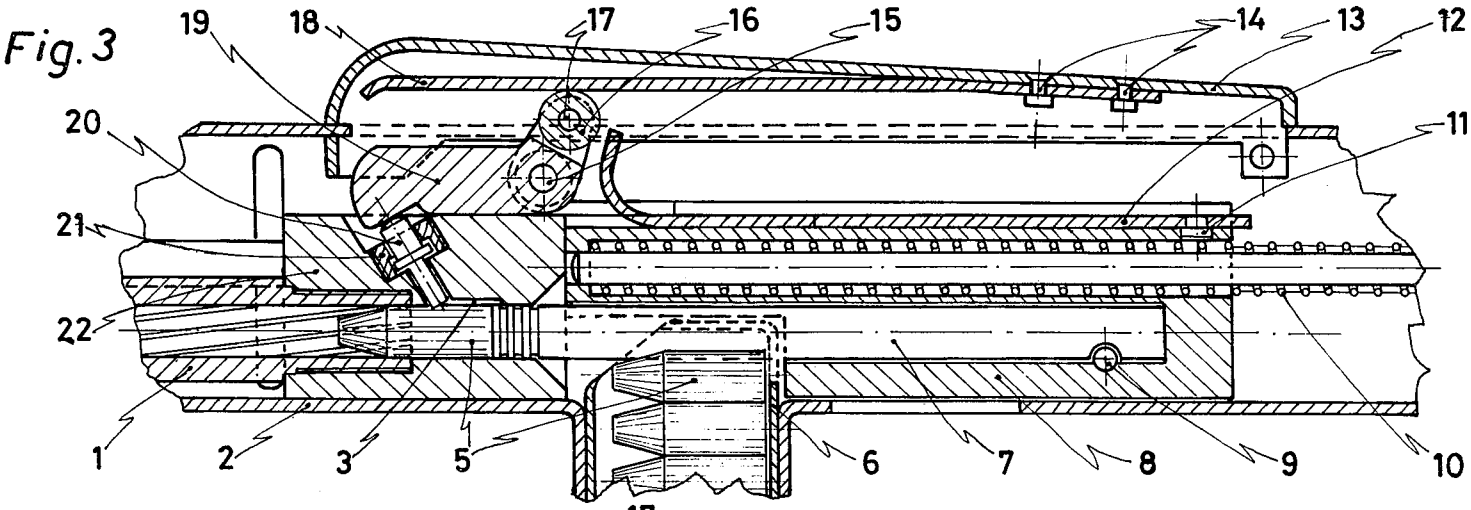
FIG. 3 is a sectional view of the radial percussion arrangement with the bolt in locking position and with the hammer in a position where it strikes the firing pin causing the percussion of the primer on the peripherial portion at the projectile by means of the force received by the L-shaped flat spring fastened to the bolt.

As it may be seen from FIG. 3, the velocity that the hammer 19 acquires at this time is so high that, at the time of the impact with the firing pin 20, the latter develops such a kinetic energy as to cause the percussion and therefore the ignition of the peripherical primer. It will be apparent from FIG. 3 that the flat spring 12 does not follow the hammer 19 in the rotation about the pivot 15, but the spring 12 imparts to the hammer 19 only the necessary force to rotate in a counterclockwise direction with such a velocity as to develop a sufficient energy to strike the projectile 5. The reaction of the projectile 5 to the percussion is very quick. As it is seen in FIG. 4, the projectile 5 begins soon to move forwardly thereby causing the retraction of the firing pin 20 in the seat provided therefore without being deformed or scored. This is possible because the firing pin at this time does not resist the action of the projectile 5. This is due to the fact that the hammer 19 is very light and therefore instantaneously exhausts its thrust force on the firing pin 20, being also aided by the action of the leaf spring 18 that urges the hammer upwardly while the bolt 8 remains still in a stationary position against the locking surface of the breech 22.

Also, the gases developed by the charge explosion act on the tip of the firing pin 20 through the radial passage 3 provided in the chamber 4 and, in so doing, cause the firing pin 20 to be retracted within the seat provided therefore.

Thus, the projectile 5 can be ejected from the barrel without being deformed or scored by the firing pin 20.

In this step, the bolt 8, which was still in a stationary position against the locking surface of the breech 22, begins to move rearwardly towards the unlocking position under the action of the gases developed by the charge explosion while maintaining the weapon locked until the locking rod 7 is fully retracted from the chamber 4 in the breech 22.

This prevents the escape from the breech face of the expanding gases, which would impair the sealing of the system and the safety of the shooter. Thus, there is provided for the lack of cartridge case in the new type of projectile without impairing the operation of the arrangement according to the invention.

The described arrangement attains therefore the purpose of obtaining the percussion of the new type of projectile without deformations or scores which could lead to aerodynamical changes in the trajectory thereof resulting in a lack of firing precision. The invention can be practised in a manner other than that heretofore described, without departing from the spirit and scope of the invention. Accordingly, the above described embodiment of the invention is to be intended as an illustration and not in limiting sense. Thus, it is obvious that many changes and modifications within the scope of the appended claims can be made thereto.

What we claim is:

1. A radial percussion arrangement for firearms using self-propelling projectiles with peripherial priming comprising a receiver including a breech unit mounted therein;

a projectile chamber extending longitudinally within an intermediate part of said breech unit;

a bore located within said breech unit, said bore inclined downwardly and rearwardly and in communication with said projectile chamber;

a firing pin mounted for free sliding movement within said bore, said firing pin having an upper portion, and said firing pin further having a lower tip portion projecting into said projectile chamber when there is an absence of a projectile therein;

a hammer pivotally mounted on said receiver, said hammer having a forward end extending on one side of said pivot and a rearward end extending on the other side of said pivot;

a longitudinally movable bolt located rearwardly of said receiver, said bolt including a locking rod mounted thereon for contacting and introducing a projectile into said projectile chamber as said bolt is moved forwardly to contact said breech;

a flat spring mounted on an upper portion of said bolt, said flat spring having a front end portion for contacting said rearward end of said hammer as said bolt moves forwardly, said front end portion located to be able to contact said rearward end of said hammer prior to the contact of said bolt with said breech; and said forward end of said hammer pivotable upon said contact of said flat spring to strike said upper portion of said firing pin and effect percussion of the projectile in said projectile chamber and move said firing pin upwardly in said bore.

2. An arrangement according to claim 1 wherein said front end portion of said leaf spring extends upwardly with a free upper end to provide a yieldable contact with said hammer.

3. An arrangement according to claim 2 wherein said rearward end of said hammer includes a roller that is contacted by said free upper end.

4. An arrangement according to claim 1 wherein a locking nut is mounted within said bore, said firing pin being slidable within said locking nut, and said locking nut providing a limit stop for said firing pin.

5. An arrangement according to claim 1 wherein a passage is formed in said projectile chamber, said passage located rearwardly, adjacent to and in communication with said bore, and said passage receiving gases from the percussion to cause said firing pin to move upwardly in said bore.

6. An arrangement according to claim 1 wherein a leaf spring is mounted to contact said rearward end of said roller and exert a downward pressure thereon that is overcome by the contact of said front end of said flat spring with said rearward end of said hammer.

* * * * *